US010577962B2

(12) United States Patent
Mohr et al.

(10) Patent No.: US 10,577,962 B2
(45) Date of Patent: Mar. 3, 2020

(54) TURBOMACHINE TEMPERATURE CONTROL SYSTEM

(71) Applicant: General Electric Company, Schenectady, NY (US)

(72) Inventors: Wolfgang Franz Dietrich Mohr, Niederweningen (CH); Erhard Friedrich Liebig, Laufenburg (DE); Kurt Rechsteiner, Buchs (CH)

(73) Assignee: General Electric Company, Schenectady, NY (US)

( * ) Notice: Subject to any disclaimer, the term of this patent is extended or adjusted under 35 U.S.C. 154(b) by 718 days.

(21) Appl. No.: 15/258,080

(22) Filed: Sep. 7, 2016

(65) Prior Publication Data

US 2018/0066534 A1 Mar. 8, 2018

(51) Int. Cl.

| | |
|---|---|
| ***F01D 11/06*** | (2006.01) |
| ***F01D 25/10*** | (2006.01) |
| ***F01K 13/02*** | (2006.01) |

(52) U.S. Cl.

CPC ..... *F01D 11/06* (2013.01); *F01D 25/10* (2013.01); *F01K 13/02* (2013.01); *F05D 2220/31* (2013.01); *F05D 2240/55* (2013.01); *F05D 2260/20* (2013.01)

(58) Field of Classification Search

CPC ..... F01D 19/00; F01D 17/145; F01D 11/04; F01D 11/06; F01D 25/10; F01K 13/02

See application file for complete search history.

(56) References Cited

U.S. PATENT DOCUMENTS

| | | | | |
|---|---|---|---|---|
| 3,604,206 | A * | 9/1971 | Baily | F01D 11/06 277/432 |
| 4,353,216 | A | 10/1982 | Dickenson | |
| 4,398,393 | A * | 8/1983 | Ipsen | F01D 19/02 137/495 |
| 4,651,532 | A * | 3/1987 | Abe | F01K 7/24 60/646 |
| 5,412,936 | A | 5/1995 | Lee et al. | |
| 8,899,909 | B2 * | 12/2014 | Pandey | F01D 25/12 415/1 |

(Continued)

FOREIGN PATENT DOCUMENTS

| | | |
|---|---|---|
| DE | 10227709 B4 | 7/2011 |
| DE | 102012200769 A1 | 7/2013 |

(Continued)

OTHER PUBLICATIONS

European Search Report issued in connection with corresponding EP Application No. 17189512.1, dated May 24, 2018, 7 pages.

*Primary Examiner* — Christopher Verdier
*Assistant Examiner* — Jason A Fountain
(74) *Attorney, Agent, or Firm* — Perttu Juhana Henttonen; Hoffman Warnick LLC

(57) ABSTRACT

Various embodiments include a system having: a first steam turbine coupled with a shaft; a seal system coupled with the shaft, the seal system including a set of linearly disposed seal locations on each side of the steam turbine along the shaft, each seal location corresponding with a control valve for controlling a flow of fluid therethrough; and a control system coupled with each of the control valves, the control system configured to control flow of a dry air or gas to at least one of the seal locations for heating the system.

19 Claims, 2 Drawing Sheets

(56) References Cited

U.S. PATENT DOCUMENTS

| | | | | |
|---|---|---|---|---|
| 9,032,733 | B2 * | 5/2015 | Dalsania | F01K 21/00 60/646 |
| 9,556,752 | B2 * | 1/2017 | Potter | F01D 19/00 |
| 2004/0045300 | A1 | 3/2004 | Davali-Solis | |
| 2004/0088984 | A1 | 5/2004 | Gobrecht et al. | |
| 2009/0126365 | A1 | 5/2009 | Gobrecht et al. | |
| 2009/0249788 | A1 | 10/2009 | Diesterbeck et al. | |
| 2009/0288415 | A1 | 11/2009 | Gobrecht et al. | |
| 2012/0324862 | A1 * | 12/2012 | Pandey | F01D 25/12 60/39.182 |
| 2015/0047354 | A1 * | 2/2015 | Potter | F01D 19/00 60/646 |
| 2017/0183977 | A1 * | 6/2017 | Brune | F01D 21/00 |

FOREIGN PATENT DOCUMENTS

| | | | |
|---|---|---|---|
| DE | 102014221676 | A1 | 4/2016 |
| EP | 1674667 | A1 | 6/2006 |
| EP | 2492456 | A1 | 8/2012 |
| EP | 2511485 | A1 | 10/2012 |
| EP | 2511497 | A2 | 10/2012 |
| EP | 2573332 | A1 | 3/2013 |
| EP | 2657467 | A1 | 10/2013 |
| EP | 2738360 | A1 | 4/2014 |
| WO | 2008107406 | A2 | 9/2008 |
| WO | 2013144217 | A1 | 10/2013 |

* cited by examiner

TURBOMACHINE TEMPERATURE CONTROL SYSTEM

TECHNICAL FIELD

The subject matter disclosed herein relates to power systems. More particularly, the subject matter disclosed herein relates to controlling temperatures and temperature differentials in steam turbine power systems.

BACKGROUND

Turbomachines, including steam turbine power systems (also referred to as steam turbines or steam turbomachines), are employed in thermal power plants and may also be utilized in a combined-cycle configuration whereby steam is preheated prior to entering the turbine. A combined-cycle configuration includes a gas turbine and a heat recovery steam generator (HRSG), which utilizes exhaust from the gas turbine to generate steam for subsequent use in the steam turbine. When starting a steam turbine, e.g., from a cold or relatively cold state, it is desirable to heat the thick-walled components of the steam turbine to operational temperatures. During this time, the steam generating components (e.g., boiler, gas turbine and HRSG) are typically run at a sub-design level load so as to provide lower-temperature steam (relative to operating temperature steam) to the steam turbine, thereby limiting the temperature difference (and with it, the thermal expansion stresses) within the turbine components. Running higher-temperature steam through the steam turbine at the start-up phase can shorten the usable life of its components or can damage the turbine, e.g., by fracture initialization or plastic deformation. However, operating the steam generator at lower loads can waste fuel due to its lower efficiency, and the corresponding lower efficiency of the steam turbine. Furthermore, operating at these lower loads can yield higher emission levels due to less complete combustion.

BRIEF DESCRIPTION

Various embodiments of the disclosure include a system having: a first steam turbine coupled with a shaft; a seal system coupled with the shaft, the seal system including a set of linearly disposed seal locations on each side of the steam turbine along the shaft, each seal location corresponding with a control valve for controlling a flow of fluid there through; and a control system coupled with each of the control valves, the control system configured to control flow of a dry air or gas to at least one of the seal locations for heating the system.

A first aspect of the disclosure includes a system having: a first steam turbine coupled with a shaft; a seal system coupled with the shaft, the seal system including a set of linearly disposed seal locations on each side of the steam turbine along the shaft, each seal location corresponding with a control valve for controlling a flow of fluid therethrough; and a control system coupled with each of the control valves, the control system configured to control flow of a dry air or gas to at least one of the seal locations for heating the system.

A second aspect of the disclosure includes a system having: a first steam turbine coupled with a shaft; a seal system coupled with the shaft, the seal system including a set of linearly disposed seal locations on each side of the first steam turbine along the shaft, each seal location corresponding with a control valve for controlling a flow of fluid therethrough; and a control system coupled with each of the control valves, the control system configured to permit flow of a dry air or gas to at least one of the seal locations in response to determining the first steam turbine is in a startup mode, wherein the dry air or gas is heated by an external heating system.

A third aspect of the disclosure includes a system having: a steam turbine coupled with a shaft; a seal system coupled with the shaft, the seal system including a set of linearly disposed seal locations on each side of the steam turbine along the shaft, each seal location corresponding with a control valve for controlling a flow of fluid therethrough; and a control system coupled with each of the control valves, the control system configured to permit flow of a dry air or gas consisting substantially of nitrogen ($N_2$) to at least one of the seal locations in response to determining the steam turbine is in a startup mode, wherein the dry air or gas is heated by at least one of relief steam from the steam turbine or another steam turbine, gland seal steam from the steam turbine or the another steam turbine, or leak-off steam from the steam turbine or the another steam turbine.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
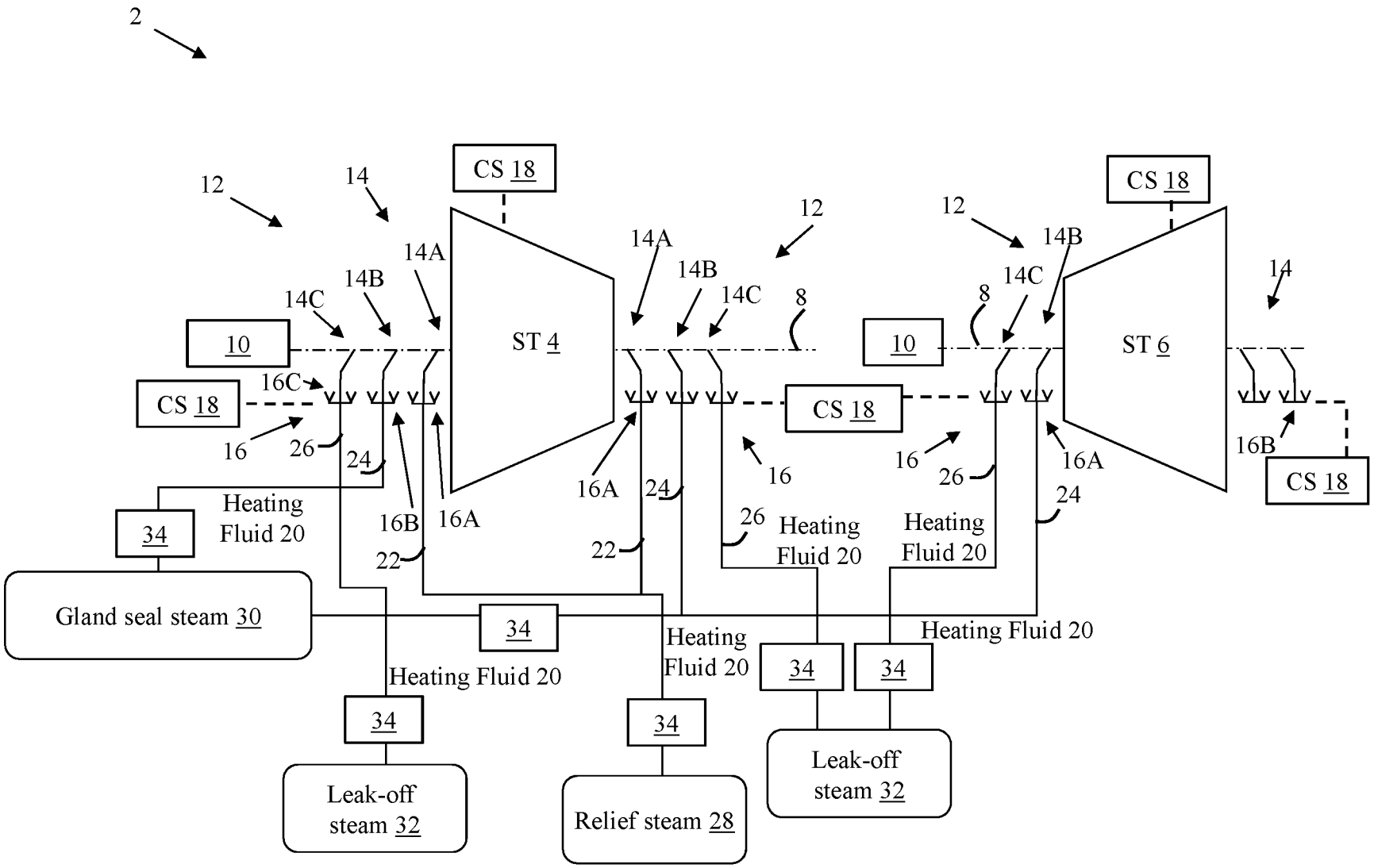
FIG. 1 is a schematic depiction of a system according to various embodiments of the disclosure.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION

As indicated above, the subject matter disclosed herein relates to power systems. More particularly, the subject matter disclosed herein relates to controlling heat differentials in steam turbine power systems.

In the following description, reference is made to the accompanying drawings that form a part thereof, and in which is shown by way of illustration specific example embodiments in which the present teachings may be practiced. These embodiments are described in sufficient detail to enable those skilled in the art to practice the present teachings and it is to be understood that other embodiments may be utilized and that changes may be made without departing from the scope of the present teachings.

FIG. 1 is a schematic depiction of a system 2 according to various embodiments. In various embodiments, system 2 is a steam turbine system, such as a combined-cycle steam turbine system. System 2 can include a first steam turbine 4 and a second steam turbine 6, each of which may be coupled to a common, or separate, shaft(s) 8. As is known in the art, steam turbine(s) 4, 6 can translate thermal energy from steam into rotational energy, via shaft(s) 8, which may be used, e.g., to drive one or more dynamoelectric machines 10 (e.g., generators). In various embodiments, first steam turbine 4 includes a high pressure or combined high pressure/intermediate pressure steam turbine, and second steam turbine 6 includes an intermediate pressure steam turbine, a combined intermediate pressure/low pressure steam turbine, or a low pressure steam turbine.

With particular attention on first steam turbine 4, system 2 can further include a seal system 12 coupled with shaft 8, where seal system 12 includes a set of linearly disposed (along shaft 8) seal locations 14 on each side of steam turbine 4. Each seal location 14 can have a corresponding control valve 16 for controlling a flow of fluid therethrough. It is understood that according to various embodiments, seal system 12 includes a labyrinth seal system, with linearly overlapping seal components forming a seal around shaft 8. In various embodiments, each seal location is bordered by two adjacent seals, such that three (3) seal locations are formed from four (4) physical seals. A control system 18 can be coupled with each of the control valves 16, where control system 18 is configured to control flow of a dry air or gas to at least one of seal locations 14 for pre-heating system 2. In various embodiments, dry air or gas may have a dew point less than −20 degrees Celsius. In some cases, dry air or gas has an oil content of less than approximately 0.01 milligrams (mg) per cubic meter ($m^3$).

Control system 18 may be mechanically or electrically connected to control valves 16 such that control system 18 may actuate one or more control valves 16. Control system 18 may actuate control valves 16 in response to a load change, operating mode indication (e.g., startup operating mode, shutdown operating mode, steady-state operating mode), or other indicator on first steam turbine 4 or second steam turbine 6 (and similarly, a load change on system 2). Control system 18 may be a computerized, mechanical, or electro-mechanical device capable of actuating valves (e.g., control valves 16). In one embodiment control system 18 may be a computerized device capable of providing operating instructions to control valves 16. In this case, control system 18 may monitor the load of first steam turbine 4 and/or second steam turbine 6 (and optionally, system 2) by monitoring the flow rates, temperature, pressure and other working fluid parameters of steam passing through first steam turbine 4 and/or second steam turbine 6 (and system 2), and provide operating instructions to control valves 16. For example, control system 18 may send operating instructions to a first (control) valve 16A, second (control) valve 16B, or third (control) valve 16C under certain operating conditions (e.g., to permit flow of a heating fluid 20, such as hot air or gas, during startup conditions). In this embodiment, first valve 16A, second valve 16B and/or third valve 16C may include electro-mechanical components, capable of receiving operating instructions (electrical signals) from control system 18 and producing mechanical motion (e.g., partially closing first valve 16A, second valve 16B and/or third valve 16C). In another embodiment, control system 18 may include electrical, mechanical or electro-mechanical components (which may include programmable software components), configured to generate a set-point for the temperature of the heating fluid 20. In another embodiment, control system 18 may include a mechanical device, capable of use by an operator. In this case, the operator may physically manipulate control system 18 (e.g., by pulling a lever), which may actuate first valve 16A, second valve 16B and/or third valve 16C. For example, the lever of control system 18 may be mechanically linked to first valve 16A, second valve 16B and/or third valve 16C, such that pulling the lever causes the first valve 16A, second valve 16B and/or third valve 16C to fully actuate (e.g., by opening the flow path through a first conduit 22, second conduit 24 or third conduit 26, respectively). In another embodiment, control system 18 may be an electro-mechanical device, capable of electrically monitoring (e.g., with sensors) parameters indicating the first steam turbine 4 or second steam turbine 6 (and, optionally, system 2) is running at a certain load condition (e.g., in startup mode) or stand-by conditions, and mechanically actuating first valve 16A, second valve 16B and/or third valve 16C. While described in several embodiments herein, control system 16 may actuate first valve 16A, second valve 16B and/or third valve 16C through any other conventional means.

According to various embodiments, and in contrast to conventional approaches, system 2 is configured to control a flow of a heating fluid 20, such as dry air or gas to/from one or more seal locations 14 in order to reduce a heat differential in the seal locations 14 (and their corresponding steam turbines 4, 6, for example, during startup conditions). This may include "pre-warming" seal locations 14 (and related components) such that the temperature of those locations is closer to the temperature of the hot steam entering the system during startup, relative to a cold (not pre-warmed system). In some cases, the dry air or gas consists substantially of nitrogen (N2).

According to various embodiments, seal locations 14 can include a plurality of seal locations, for example, three seal locations 14. It is understood that as described herein, each seal location 14 can be formed from two adjacent labyrinth seals, such that the three seal locations 14 are formed between four adjacent labyrinth seals. First control valve 16A corresponds with a first seal location 14A adjacent first steam turbine 4, second control valve 14B corresponds with a second seal location 14B adjacent first seal location 14A (and farther from first steam turbine 4 than first seal location 14A), and third control valve 16C corresponds with a third seal location 14C adjacent second seal location 14B and farther from first steam turbine 4 than second seal location 14B.

According to various embodiments, control system 18 can be configured to perform functions to reduce heat differentials in system 2, including, for example in first steam turbine 4 and/or second steam turbine 6. In some cases control system 18 is configured to open first control valve 16A and permit flow of heating fluid 20 (dry air or gas) to first seal location 14A in response to determining first steam turbine 4 is operating in a startup mode or a pre-warmed, stand-by mode. Startup mode may be indicated, for example, by an increasing load, steam flow rate, gas flow rate, etc., from an operating state that is similar to or below steady-state for the first steam turbine 4. In some cases, control system 18 can determine that first steam turbine 4 is operating in a startup mode by obtaining instructions to initiate operation of first steam turbine 4. In these cases, heating fluid 20 (dry air or gas) can be extracted from relief steam 28 from first steam turbine 4, e.g., by heat exchanger 34, and may be injected as heating fluid 20 into second steam turbine 6.

In other embodiments, control system 18 is configured to open second control valve 16B and permit flow of the heating fluid 20 (dry air or gas) to second seal location 14B in response to determining first steam turbine 4 is operating in startup mode. In these cases, heating fluid 20 (dry air or gas) can be heated by gland seal steam 30 from first steam turbine 4 or second steam turbine 6 (via heat exchanger 34) or injected as heating fluid 20 into second steam turbine 6.

In other embodiments, control system 18 is configured to open third control valve 16C and permit flow of heating fluid 20 (dry air or gas) to third seal location 14C in response to determining first steam turbine 4 is operating in startup mode. In these cases, heating fluid 20 (dry air or gas) can be heated by leak-off steam 32 from first steam turbine 4 or second steam turbine 6 (via heat exchanger 34), or injected as heating fluid 20 into second steam turbine 6.

In some embodiments, the control scenarios described herein can be combined, for example, initiating flow of heating fluid 20 heated by leak-off steam 32 to third seal location 14C along with one or both of heating fluid 20 heated by gland seal steam 30 at second seal location 14B and/or heating fluid 20 heated by relief steam 28 at first seal location 14A. According to various embodiments, heating fluid 20 is heated using a heat exchanger 34 (several shown, schematically) to transfer heat from one or more sources (e.g., relief steam 28, gland seal steam 30 and/or leak-off steam 32) to heating fluid 20. It is understood that heat exchanger 34 can further include, or be coupled with, a filter system 36 for filtering or otherwise preparing heating fluid 20 for use as described herein. Using dry air or gas as heating fluid 20 can provide benefits in terms of pre-heating of steam turbines 4, 6, while extending the useful life of those turbines and their ancillary components, for example, by reducing moisture and/or $CO_2$ exposure in these components compared with steam pre-heating performed in conventional approaches.

FIG. 1 additionally depicts another embodiment, shown with respect to steam turbine 6, where seal locations 14 include two seal locations 14B and 14C, where relief steam 28 (FIG. 2) is not used to preheat first steam turbine 4. In these embodiments, first seal location 14A may not be included, and second seal location 14B and/or third seal location 14C are used in control functions. In these cases, control system 18 can be configured to open control valve 16B and permit flow of heating fluid 20, heated by gland seal steam 30, to second seal location 14B, or to open control valve 16C and permit flow of heating fluid 20, heated by leak-off steam 32, to third seal location 14C, in response to determining first steam turbine 4 is operating in startup mode.

Figure 2:
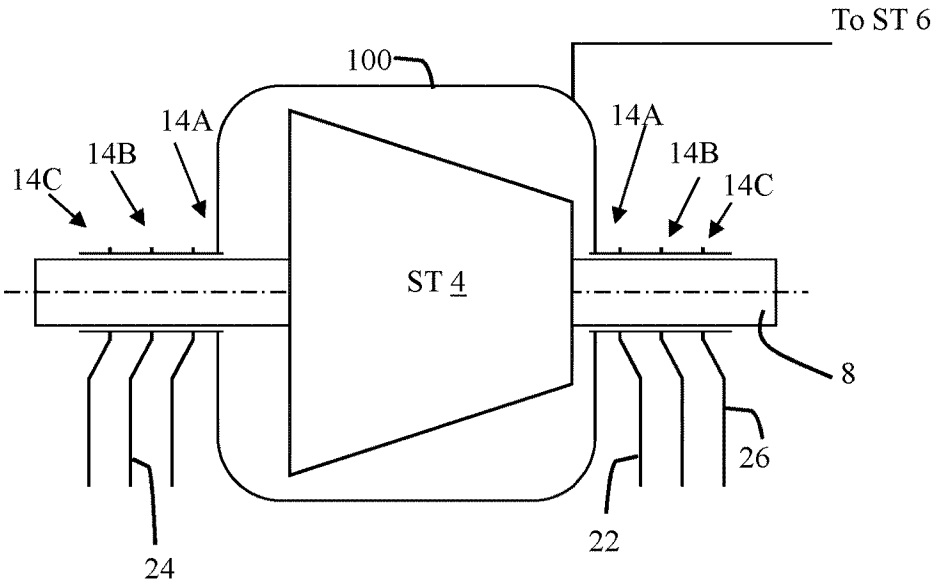
FIG. 2 shows a schematic depiction of an embodiment of a first double-shell steam turbine according to various embodiments of the disclosure.
Figure 3:
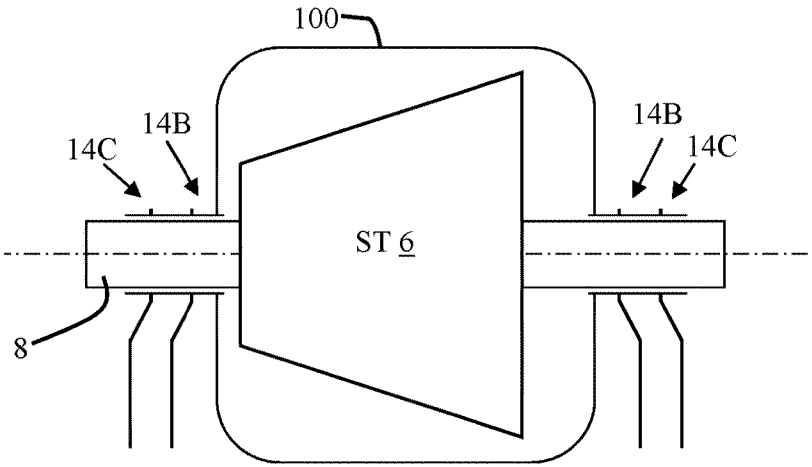
FIG. 3 shows a schematic depiction of a second double-shell steam turbine according to various embodiments of the disclosure.

FIG. 2 shows a schematic depiction of an embodiment of first steam turbine 4, and FIG. 3 shows a schematic depiction of an embodiment of second steam turbine 6, each including a double shell configuration. As shown, first steam turbine 4 and/or second steam turbine 6 can include a second, outer shell 100, which may have seal locations 14A, 14B, 14C as described with respect to FIG. 1, sealing portions of outer shell 100 with respect to shaft 8. It is understood that first steam turbine 4 and/or second steam turbine 6 can include single or double-shell configurations according to any embodiments disclosed herein.

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., fastening, ultrasonic welding, bonding).

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A system comprising: a first steam turbine coupled with a shaft; a seal system coupled with the shaft, the seal system including a set of linearly disposed seal locations on each side of the first steam turbine along the shaft, each seal location corresponding with a control valve for controlling a flow of fluid therethrough, wherein the set of linearly disposed seal locations includes two seal locations, wherein a first control valve corresponds with a first seal location adjacent the first steam turbine and a second control valve corresponds with a second seal location adjacent the first seal location and farther from the first steam turbine than the first seal location, wherein the control system is configured to: open the first control valve and permit flow of a dry air or gas to the first seal location, or open the second control valve and permit flow of the dry air or gas to the second seal location in response to determining the first steam turbine is operating in the startup mode; and a control system coupled with the control valves, the control system configured to control flow of the dry air or gas to at least one of the seal locations for preheating the first steam turbine in response to determining the first steam turbine is in a startup mode.

2. The system of claim 1, wherein the gas consists substantially of nitrogen ($N_2$).

3. The system of claim 1, wherein the set of linearly disposed seal locations includes a third seal location, wherein a third control valve corresponds with a third seal location adjacent the second seal location and farther from the first steam turbine than the second seal location.

4. The system of claim 3, wherein the control system is configured to open the first control valve and permit flow of the dry air or gas to the first seal location in response to determining the first steam turbine is operating in the startup mode.

5. The system of claim 3, wherein the control system is configured to open the second control valve and permit flow of the dry air or gas to the second seal location in response to determining the first steam turbine is operating in the startup mode.

6. The system of claim 3, wherein the control system is configured to open the third control valve and permit flow of the dry air or gas to the third seal location in response to determining the first steam turbine is operating in the startup mode.

7. The system of claim 3, wherein the control system is configured to open the first control valve and the third control valve and permit flow of the dry air or gas to the first seal location and the third seal location, respectively in response to determining the first steam turbine is operating in the startup mode.

8. The system of claim 1, further comprising a second steam turbine coupled with the shaft.

9. The system of claim 8, wherein the first steam turbine includes a high-pressure steam turbine, and wherein the second steam turbine includes an intermediate pressure steam turbine, or a low pressure steam turbine.

10. The system of claim 1, wherein the control system includes at least one computing device.

11. The system of claim 1, wherein the dry air or gas is heated using a heat exchanger to transfer heat from one or more heat sources to the dry air or gas.

12. The system of claim 11, wherein the one or more heat sources includes relief steam from the first steam turbine or a second steam turbine, gland seal steam from the first steam turbine or the second steam turbine, or leak-off steam from the first steam turbine or the second steam turbine.

13. A system comprising:

a first steam turbine coupled with a shaft;

a seal system coupled with the shaft, the seal system including a set of linearly disposed seal locations on each side of the first steam turbine along the shaft, each seal location corresponding with a control valve for controlling a flow of fluid therethrough; and a control system coupled with each of the control valves, the control system configured to permit flow of a dry air or gas to at least one of the seal locations in response to determining the first steam turbine is in a startup mode, wherein the dry air or gas is heated by at least one of relief steam from the first steam turbine or a second steam turbine, gland seal steam from the first steam turbine or the second steam turbine, or leak-off steam from the first steam turbine or the second steam turbine.

14. The system of claim 13, wherein the gas consists substantially of nitrogen ($N_2$).

15. The system of claim 13, wherein the set of linearly disposed seal locations includes three seal locations, wherein a first control valve corresponds with a first seal location adjacent the first steam turbine, a second control valve corresponds with a second seal location adjacent the first seal location and farther from the steam turbine than the first seal location, and a third control valve corresponds with a third seal location adjacent the second seal location and farther from the steam turbine than the second seal location.

16. The system of claim 15, wherein the control system is configured to open the first control valve and permit flow of the dry air or gas to the first seal location, wherein the dry air or gas at the first seal location is heated by the relief steam.

17. The system of claim 15, wherein the control system is configured to open the second control valve and permit flow of the dry air or gas to the second seal location, wherein the dry air or gas at the second seal location is heated by the gland seal steam.

18. The system of claim 15, wherein the control system is configured to open the third control valve and permit flow of the dry air or gas to the third seal location, wherein the dry air or gas at the third seal location is heated by the leak-off steam.

19. A system comprising:

a steam turbine coupled with a shaft;

a seal system coupled with the shaft, the seal system including a set of linearly disposed seal locations on each side of the steam turbine along the shaft, each seal location having a corresponding control valve for controlling a flow of fluid therethrough; and a control system coupled with each of the control valves, the control system configured to permit flow of a dry air or gas consisting substantially of nitrogen ($N_2$) to at least one of the seal locations in response to determining the steam turbine is in a startup mode, wherein the dry air or gas is heated by at least one of relief steam from the steam turbine or another steam turbine, gland seal steam from the steam turbine or the another steam turbine, or leak-off steam from the steam turbine or the another steam turbine.

* * * * *